US005293946A

United States Patent [19]

Besson et al.

[11] Patent Number: 5,293,946

[45] Date of Patent: Mar. 15, 1994

[54] DIVERGENT FLUID NOZZLE FOR DRILLING TOOL

[75] Inventors: Alain Besson, Sartrouville; Bernard Ponineau, Pau, both of France

[73] Assignees: Total, Puteaux, France; Diamant Boart Stratabit, Brussels, Belgium

[21] Appl. No.: 945,392

[22] Filed: Sep. 16, 1992

[30] Foreign Application Priority Data

Sep. 16, 1991 [FR] France ..... 91 11371

[51] Int. Cl.[5] ..... E21B 10/18

[52] U.S. Cl. ..... 175/424

[58] Field of Search ..... 175/56, 67, 393, 374, 175/424

[56] References Cited

U.S. PATENT DOCUMENTS 4,185,706 1/1980 Baker, III et al. .

4,531,592 7/1985 Hayatdavoudi ..... 175/67

4,703,814 11/1987 Nguyen .

4,723,612 2/1988 Hicks ..... 175/393

5,009,272 4/1991 Walter ..... 175/67

FOREIGN PATENT DOCUMENTS 146252 6/1985 European Pat. Off. .

*Primary Examiner*—Ramon S. Britts

*Assistant Examiner*—Frank S. Tsay

*Attorney, Agent, or Firm*—Sughrue, Mion, Zinn, Macpeak and Seas

[57] ABSTRACT

A drilling fluid nozzle 12 mounted in the end of an earth drilling tool 10 has a flow channel defined by a surrounding wall 16 which diverges at an angle of 30° or less, such that the exiting fluid "adheres" to the wall in a laminar manner due to the Coanda effect. This configuration minimizes clogging, and implements ready unclogging.

4 Claims, 1 Drawing Sheet

DIVERGENT FLUID NOZZLE FOR DRILLING TOOL

BACKGROUND OF THE INVENTION

This invention concerns nozzles for drilling tools which work rock by abrading or shearing it, e.g., a one-piece tool fitted with blades or cutting edges made of diamond, polycrystalline diamond compacts or PDC, tungsten carbide, etc.

These nozzles must possess good irrigation, cleaning, and blade-cooling and cutting edge-cooling properties, and must drain off debris effectively.

It is known that cylindrical or convergent nozzles give excellent performance as regards destruction of rock, since they concentrate the flow of irrigation fluid on a small section. They are used for this purpose in tools fitted with tricone bits.

In the case of one-piece tools, the most important factor is not that of the destruction of the rock by hydraulic impact, but rather that of a homogeneous irrigation of the entire functional surface of the tool. This result could certainly be achieved by fitting the one-piece tool with wide nozzles which produce wide-cross-section jets of fluid and which have the further advantage of not permitting clogging with rock debris; however, in the event that clogging, a rare but potential phenomenon, should occur, unclogging would prove difficult, since, in a wide nozzle, the loss of head or pressure drop is low. Should the tool incorporate several other wide, unclogged nozzles, there would not be enough discharge available to unblock the obstructed nozzle.

One solution used to facilitate the unclogging of the nozzles might involve the choice of nozzles having a small cross-section of flow, since the high loss of head would make it possible to effect the unclogging operation. However, in this case one encounters the problem that small cross-section nozzles clog easily.

U.S. Pat. No. 4,703,814 discloses nozzles capable of being mounted or detached from a drilling tool using an Allen wrench, which saves space and contributes a tightening torque higher than those in standard nozzles. However, these nozzles in no way solve the problem set forth above, i.e., that of allowing good irrigation, self-cleaning, and good cooling of the blades and cutting edges, as well as unclogging of the nozzles. U.S. Pat. No. 4,185,706 concerns the use of cavitation-effect nozzles designed to destroy rock by cavitation. Cavitation is a destructive phenomenon caused by mini-explosions which generate destructive shockwaves. However, these nozzles do not solve the problem forming the basis of the invention.

European patent application No. 146,252 relates to an assembly of components designed to produce a nozzle resistant to very high pressures. This nozzle does not, however, have a structure that would enable it to improve cleaning, the distribution of fluid, and cooling of the drilling tool.

SUMMARY OF THE INVENTION

The purpose of the present invention is to provide a nozzle having superior irrigation, self-cleaning, and cooling properties and which is, moreover, virtually uncloggable but which can be easily unclogged in the event of obstruction. According to the invention, all of these properties are obtained using a nozzle which is divergent in form as it extends from the interior of the tool toward its surface.

This nozzle does not, in fact, mechanically hold matter, since it widens toward the outside. Furthermore, in the event of clogging, the loss of head occurring is that which obtains in its smallest inner cross-section. At this point, the loss of head between the interior and the exterior of the nozzle is high, thereby facilitating the expulsion of a plug of clogging material, especially because the receding wall of the nozzle opposes no resistance to the plug. Furthermore, the nozzle according to the invention ensures excellent irrigation of the tool, because the jet is divergent in form and can thus reach a larger area. The energy of the flow is, moreover, distributed in a wide cone of diffusion and loses its energy on impact.

In short, the nozzle according to the invention unites both the properties of wide nozzles, i.e., difficulty of clogging and good irrigation, and those of narrow nozzles, i.e., the existence of a high loss of head and thus, greater ease of expulsion of a plug of material.

It is known that discharge rates of irrigation fluid flowing in oil drilling wells are high and that they establish a state of turbulent flow. When a divergent nozzle is used, a swirling counter-current may be created at the divergent wall, because of the fact that the fluid does not "adhere" to the wall. According to another nozzle feature, this difficulty is remedied by restricting the total angle of divergence to a maximum value, i.e., of approximately 30°. It has been observed, in fact, that up to this angle, the fluid flowing in a turbulent state still "adheres" to the nozzle wall by virtue of the Coanda effect. As soon as the angle of divergence exceeds 30°, swirling counter-currents appear. In a state of laminar flow, the limiting angle is approximately 15°.

According to one variant of the invention, the wall of the nozzle incorporates, at its narrowest cross-section, a slight annular recess turned outward. This recess delimits or defines a counter-cavity containing slightly lowered pressure which thus accentuates the Coanda effect by drawing the fluid toward the divergent wall.

The invention also concerns a tool fitted with a divergent nozzle(s).

BRIEF DESCRIPTION OF THE DRAWINGS

Two embodiments of the invention will now be described with reference to the attached drawings, in which.

DETAILED DESCRIPTION OF THE PREFERRED EMBODIMENTS

Figure 1:
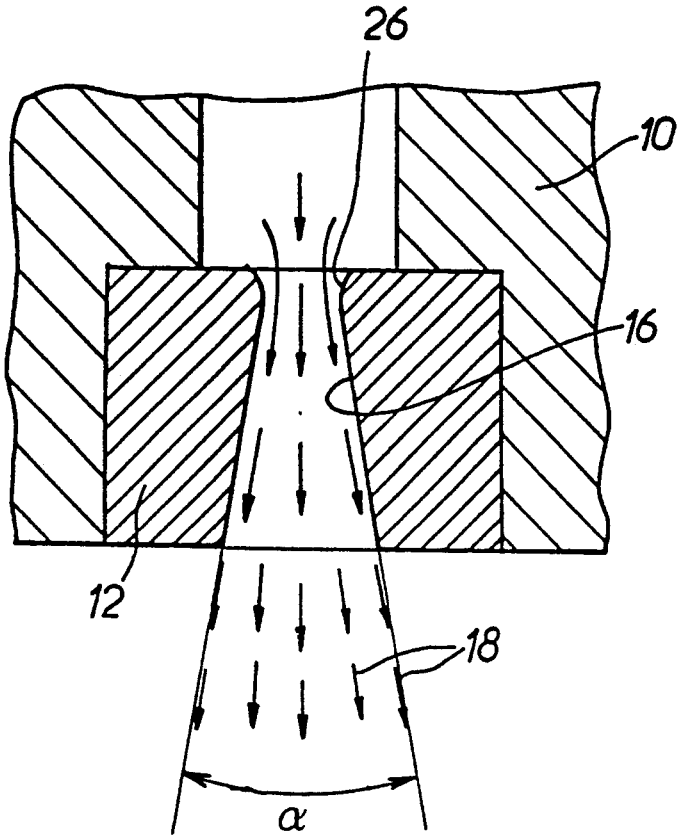
FIG. 1 is an axial cross-section of a divergent nozzle according to the invention.

As shown in FIG. 1, the tool 10 is fitted with a nozzle 12 incorporating a divergent wall 16, whose aperture angle a is less than 30°. Under these conditions, the irrigation fluid arriving in a state of turbulent flow adheres to the divergent wall 16 by virtue of the Coanda effect and is expelled as a divergent jet 18, without the creation of any counter-currents.

Figure 2:
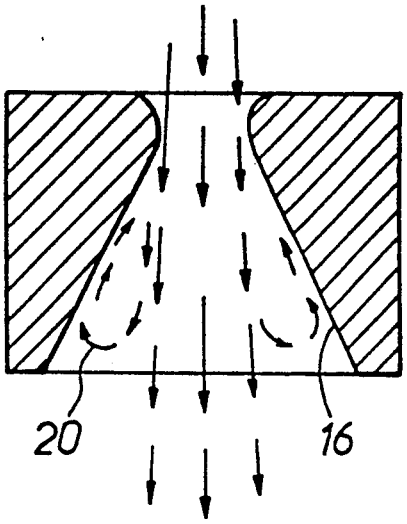
FIG. 2 is a cross-section of a divergent nozzle whose angle of opening is greater than the limiting angle.

FIG. 2 shows what happens in the case of a divergent nozzle whose aperture angle is greater than 30°. It can be seen here that the fluid does not adhere to the divergent wall 16, and that swirling counter-currents 20 are created. The major part of the fluid flow diverges to a very limited extent.

The nozzle in FIG. 1 is easily unclogged, since it diverges in the direction of circulation of the fluid. It thus corresponds to a wide cross-section nozzle, and it concurrently generates a large loss of head, as in a small cross-section nozzle. Furthermore, because of its divergent flow, it makes possible irrigation of the tool over a wide area, without irrigating some areas to the detriment of others.

Figure 3:
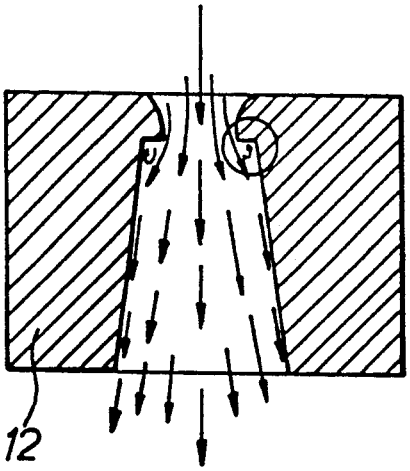
FIG. 3 is a cross-section of a divergent nozzle incorporating a recess.
Figure 4:
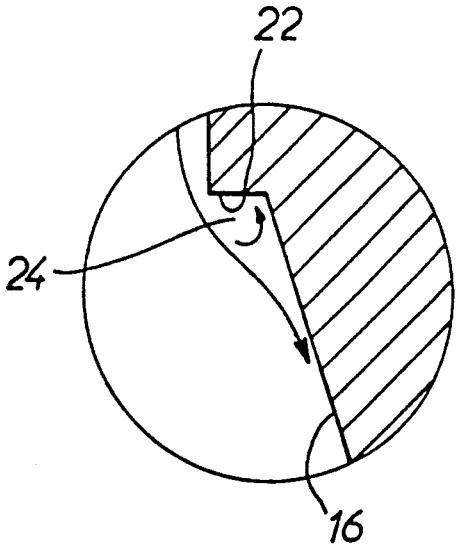
FIG. 4 is an enlarged view of the recess.

In the embodiment of FIGS. 3 and 4, a recess 22 is provided at the beginning of the divergent section, and this recess creates a slightly reduced pressure in the cavity 24 thus formed. This reduced pressure draws or attracts the fluid and thus accentuates the coanda effect whereby the fluid adheres to the divergent wall.

The nozzle may have any suitable cross-sectional shape, e.g., circular, square, or rectangular. Its wall may have a rectilinear generating line, as shown in FIG. 1, or a convex generating line. The divergent portion may be preceded by a convergent portion 26 or a cylindrical portion.

The nozzle according to the invention is particularly well-suited to one-piece drilling tools; however, in some applications, it may also be used with tools incorporating tricone bits.

We claim:

1. A drilling fluid nozzle adapted to be mounted in and for use with a one-piece borehole drilling bit (10), said nozzle comprising a drilling fluid flow channel defined by a surrounding wall (16), wherein said wall diverges from an entry end of the channel disposed in an interior of the bit to an exit end of the channel disposed at an exterior surface of the nozzle at an angle whereat the drilling fluid flows along in contact with the wall due to a Coanda effect, without the generation of any swirling counter-currents.

2. A nozzle according to claim 1, wherein the angle of divergence (a) is less than approximately 30°.

3. A nozzle according to claim 1, wherein an annular recess (22) is formed at a beginning of the divergence of the wall to define an annular cavity (24) in which the fluid pressure is reduced.

4. A nozzle according to claim 1, wherein a beginning of the divergence of the wall is preceded, in a direction of fluid flow, by one of a cylindrical and a convergent passage (26).

* * * * *